US010220986B2

(12) United States Patent
Petlak et al.

(10) Patent No.: US 10,220,986 B2
(45) Date of Patent: Mar. 5, 2019

(54) TAMPER EVIDENT CONTAINER WITH FULL TAB

(75) Inventors: Frank A. Petlak, Antioch, IL (US); Scott W. Follansbee, Round Lake Beach, IL (US); H. Bernard Kirkland, Lindenhurst, IL (US); Craig E. Cappel, Lake Villa, IL (US)

(73) Assignee: PACTIV CORPORATION, Lake Forest, IL (US)

( * ) Notice: Subject to any disclaimer, the term of this patent is extended or adjusted under 35 U.S.C. 154(b) by 1265 days.

(21) Appl. No.: 12/399,752

(22) Filed: Mar. 6, 2009

(65) Prior Publication Data

US 2010/0224630 A1 Sep. 9, 2010

(51) Int. Cl.
*B65D 43/02* (2006.01)

(52) U.S. Cl.
CPC ..... *B65D 43/0254* (2013.01); *B65D 2543/00101* (2013.01); *B65D 2543/00296* (2013.01); *B65D 2543/00351* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 17/34; B65D 55/02; B65D 50/00; B65D 17/00; B65D 43/0254
USPC ..... 220/793, 270, 266
See application file for complete search history.

(56) References Cited

U.S. PATENT DOCUMENTS 2,161,561 A 6/1939 Dalton
2,701,053 A 2/1955 Tamarin
3,462,066 A 8/1969 Farquhar
3,561,591 A 2/1971 Henderson
3,683,487 A * 8/1972 Sherman ..... B21D 53/045 228/118
3,684,124 A * 8/1972 Song ..... 220/270
3,773,207 A 11/1973 Dokoupil
3,826,420 A 7/1974 Bamburg
(Continued)

FOREIGN PATENT DOCUMENTS

EP 0109793 A2 5/1984
EP 1559656 8/2005
(Continued)

OTHER PUBLICATIONS

Inline Plastics Corp. Product Catalog dated 2008.

*Primary Examiner* — Anthony D Stashick
*Assistant Examiner* — Blaine G Neway
(74) *Attorney, Agent, or Firm* — Baker Botts L.L.P.

(57) ABSTRACT

Container includes a base, a cover, and a pull tab. The base has a bottom, a side wall extending upwardly from the bottom, and a rim at an upper edge portion of the side wall. The cover has a closed condition and an open condition and an outer edge portion interengageable with the rim of the base when the cover is in the closed condition. The pull tab extends outwardly from at least one of the base or the cover. The pull tab having a deformable formation to be deformed when the cover is moved from the closed condition to the open condition, the pull tab remaining attached to the at least one of the base or the cover when moved from the closed condition to the open condition. Additional embodiments relate to a tamper evident feature for a container, and a method for containing product in a container.

12 Claims, 9 Drawing Sheets

(56) References Cited

U.S. PATENT DOCUMENTS 3,836,039 A 9/1974 Seiferth
3,870,219 A 3/1975 Reisman
3,896,965 A 7/1975 Cornell
3,918,584 A 11/1975 Richardson
3,935,960 A 2/1976 Cornell
3,941,248 A 3/1976 Moser
4,098,577 A 7/1978 Halpern
4,134,531 A 1/1979 Martinez
4,139,121 A 2/1979 Roccaforte
4,150,748 A 4/1979 Mueller
4,262,814 A 4/1981 Roccaforte
4,287,819 A 9/1981 Emerit
4,304,335 A 12/1981 Bemiss
4,424,911 A 1/1984 Resnick
4,432,462 A 2/1984 Newkirk
4,436,203 A 3/1984 Reyner
4,449,632 A 5/1984 Marusiak, Jr.
4,453,666 A 6/1984 Gordon
4,469,241 A * 9/1984 Westphal ..... B65D 43/20 220/257.2
4,475,661 A 10/1984 Griffin
4,479,588 A 10/1984 Davis
4,489,841 A 12/1984 Thompson
4,503,123 A 3/1985 Ou Yang
4,505,389 A 3/1985 Whiteside
4,508,226 A 4/1985 Davis
4,509,196 A 4/1985 Sak
4,510,621 A 4/1985 Sak
4,520,943 A 6/1985 Nielsen
4,522,308 A * 6/1985 Sullivan ..... 215/253
4,526,752 A 7/1985 Perlman
4,534,469 A 8/1985 Elsmo
4,537,309 A 8/1985 Boorsma
4,541,541 A 9/1985 Hickman
4,546,881 A 10/1985 Tasma
4,555,056 A 11/1985 Bernhardt
4,557,505 A 12/1985 Schaefer
4,558,785 A 12/1985 Gordon
4,569,443 A 2/1986 Roccaforte
4,591,055 A 5/1986 Corn
4,609,417 A 9/1986 Smith
4,610,371 A 9/1986 Karkiewicz
4,614,297 A 9/1986 Davis
4,645,078 A 2/1987 Reyner
4,660,732 A 4/1987 Moore
4,671,453 A 6/1987 Cassidy
4,678,082 A 7/1987 Fillmore
4,678,083 A 7/1987 Anderson
4,684,024 A 8/1987 Ebrahim
4,685,578 A 8/1987 Dunshee
4,721,210 A 1/1988 Lawrence
4,746,061 A 5/1988 Arvanigian
4,747,510 A 5/1988 Mack
4,757,898 A 7/1988 Klein
4,773,541 A 9/1988 Riddell
4,778,059 A 10/1988 Martin
4,782,977 A 11/1988 Watanabe
4,785,963 A 11/1988 Magley
4,792,054 A 12/1988 Weidman
4,813,541 A 3/1989 Velasco
4,813,564 A 3/1989 Cooper
4,819,824 A 4/1989 Longbottom
4,834,552 A 5/1989 Makowka
4,838,425 A 6/1989 O'Brien
4,854,472 A 8/1989 Semersky
4,865,198 A 9/1989 Butler
4,873,193 A 10/1989 Jensen
4,874,096 A 10/1989 Tessera Chiesa
4,877,143 A 10/1989 Travisano
4,878,595 A 11/1989 Uhlig
4,881,656 A 11/1989 Chumley
4,883,182 A 11/1989 Hughes
4,890,763 A 1/1990 Curiel
4,911,302 A 3/1990 Butler
4,917,288 A 4/1990 Heitele
4,931,327 A 6/1990 Liu
4,945,708 A 8/1990 Curiel
4,960,206 A 10/1990 Johannes
4,964,561 A 10/1990 Whelan
4,966,294 A 10/1990 Mack
4,966,470 A 10/1990 Thompson
4,986,429 A 1/1991 Singleton, Jr.
5,040,695 A 8/1991 Adams
5,042,653 A 8/1991 Ems
5,064,664 A 11/1991 Hustad
5,103,979 A 4/1992 Hustad
5,111,953 A 5/1992 Faust
5,137,208 A 8/1992 Wang
5,148,970 A 9/1992 Johnston
5,149,578 A 9/1992 Wheatley
5,219,087 A 6/1993 Christensson
5,249,694 A 10/1993 Nelson
5,265,794 A 11/1993 Johnston
5,302,435 A 4/1994 Hashimoto
5,307,948 A 5/1994 Blackburn et al.
5,312,680 A 5/1994 Simpson
5,405,629 A 4/1995 Marnocha
5,437,386 A 8/1995 Von Holdt
5,495,944 A 3/1996 Lermer
5,507,406 A 4/1996 Urciuoli
5,553,701 A * 9/1996 Jarecki et al. ..... 206/15.2
5,582,853 A 12/1996 Marnocha
5,603,422 A 2/1997 Herrmann
5,607,709 A 3/1997 Fritz
5,626,251 A 5/1997 Luburic et al.
5,713,484 A * 2/1998 Setty ..... 220/790
5,758,794 A * 6/1998 Rider et al. ..... 220/523
5,788,105 A 8/1998 Foos
5,797,510 A 8/1998 Carrier
5,798,169 A 8/1998 Smith
5,836,697 A 11/1998 Chiesa
5,866,183 A 2/1999 Small
5,882,116 A 3/1999 Backus
5,897,011 A 4/1999 Brilliant
5,931,332 A 8/1999 Mygatt et al.
5,960,206 A 9/1999 Barsness
5,979,690 A 11/1999 Hartley
6,004,251 A 12/1999 Herrin
6,032,827 A * 3/2000 Zettle et al. ..... 220/788
6,050,413 A 4/2000 Benedetti
6,056,141 A 5/2000 Navarini
RE36,729 E 6/2000 Luch et al.
6,070,790 A 6/2000 Anderson
6,257,435 B1 7/2001 Chedister et al.
6,264,033 B1 7/2001 Kannabiran
6,276,529 B1 8/2001 Feehan, Jr.
6,299,012 B1 10/2001 Redmond
6,349,828 B1 2/2002 Sessions
6,436,500 B1 8/2002 Yingst
6,471,058 B2 10/2002 Kannabiran
6,564,958 B1 5/2003 Ramsey et al.
6,572,909 B1 6/2003 Bagwell
6,588,653 B1 7/2003 Schmidt
6,626,315 B2 9/2003 Lees
6,769,537 B2 8/2004 Appelabaum
6,877,631 B1 4/2005 Thompson et al.
6,916,516 B1 7/2005 Gerber
7,055,692 B2 6/2006 Waga
7,073,680 B2 * 7/2006 Boback ..... B65D 43/021 220/266
7,118,003 B2 10/2006 Sellari
7,134,567 B2 11/2006 Luburic et al.
7,141,286 B1 11/2006 Kessler et al.
7,178,867 B2 2/2007 Hough
7,201,410 B1 4/2007 Lassen
7,219,799 B2 5/2007 Bonnette
7,223,015 B2 5/2007 Steffens
7,270,874 B2 9/2007 Dalgleish
7,273,139 B2 9/2007 Lantz
7,344,744 B2 3/2008 Sierra-Gomez et al.
7,360,807 B2 4/2008 Graves
7,364,210 B2 4/2008 Schainholz et al.
7,371,008 B2 5/2008 Bonenfant
RE40,357 E 6/2008 Geyer

(56) References Cited

U.S. PATENT DOCUMENTS

| | | | | |
|---|---|---|---|---|
| 7,422,781 | B2 | 9/2008 | Gosselin | |
| 7,475,805 | B2 | 1/2009 | Visser | |
| 7,530,740 | B2 | 5/2009 | Geyer | |
| 7,568,586 | B2 | 8/2009 | Walters, Jr. | |
| 7,579,061 | B2 | 8/2009 | Dronzek, Jr. | |
| 7,594,348 | B2 | 9/2009 | Oosterlinck | |
| 7,681,732 | B2 | 3/2010 | Moehlenbrock et al. | |
| 7,695,809 | B1 | 4/2010 | Maksymkiw et al. | |
| 7,740,292 | B1 | 6/2010 | Fattori et al. | |
| 7,740,923 | B2 | 6/2010 | Exner et al. | |
| 7,767,295 | B2 | 8/2010 | Steinzor | |
| 2001/0022280 | A1 | 9/2001 | Kannabiran et al. | |
| 2004/0026286 | A1* | 2/2004 | Ramsey | 206/431 |
| 2004/0026423 | A1 | 2/2004 | Cappel | |
| 2004/0035718 | A1 | 2/2004 | Waga | |
| 2004/0118848 | A1 | 6/2004 | Marshall | |
| 2004/0150221 | A1 | 8/2004 | Brown | |
| 2004/0188304 | A1 | 9/2004 | Bonnette et al. | |
| 2005/0017007 | A1 | 1/2005 | Sellari | |
| 2005/0161455 | A1 | 7/2005 | Studee | |
| 2005/0173435 | A1 | 8/2005 | Wellman | |
| 2005/0184070 | A1 | 8/2005 | Boback | |
| 2005/0247764 | A1 | 11/2005 | Sierra-Gomez et al. | |
| 2006/0006178 | A1 | 1/2006 | Foldesi | |
| 2006/0011632 | A1 | 1/2006 | Caille | |
| 2006/0018569 | A1 | 1/2006 | Bonenfant | |
| 2006/0108405 | A1 | 5/2006 | Sanchez et al. | |
| 2006/0163265 | A1 | 7/2006 | De Candido | |
| 2006/0213800 | A1 | 9/2006 | Ballard | |
| 2006/0234040 | A1 | 10/2006 | Liu et al. | |
| 2006/0234014 | A1 | 11/2006 | Liu et al. | |
| 2006/0255054 | A1 | 11/2006 | Vovan | |
| 2006/0278652 | A1 | 12/2006 | Vovan | |
| 2006/0289549 | A1* | 12/2006 | Vovan | 220/791 |
| 2007/0012710 | A1* | 1/2007 | Vovan | 220/793 |
| 2007/0045317 | A1 | 3/2007 | Rosender | |
| 2007/0054117 | A1 | 3/2007 | Katchko et al. | |
| 2007/0062949 | A1* | 3/2007 | Bordner | 220/268 |
| 2007/0071968 | A1 | 3/2007 | Hermony et al. | |
| 2007/0082163 | A1 | 4/2007 | Bolnick et al. | |
| 2007/0133909 | A1 | 6/2007 | Arvizu | |
| 2007/0138180 | A1 | 6/2007 | Vovan | |
| 2007/0275133 | A1 | 11/2007 | Sierra-Gomez et al. | |
| 2007/0284372 | A1 | 12/2007 | Gnepper | |
| 2008/0000904 | A1 | 1/2008 | Vovan | |
| 2008/0006632 | A1 | 1/2008 | Vovan | |
| 2008/0029345 | A1 | 2/2008 | Shafir | |
| 2008/0056622 | A1 | 3/2008 | Austreng et al. | |
| 2008/0217931 | A1 | 9/2008 | Bourrieres et al. | |
| 2008/0308613 | A1 | 12/2008 | Freder | |
| 2008/0314904 | A1 | 12/2008 | Perra | |
| 2009/0050253 | A1 | 2/2009 | Thomas et al. | |
| 2009/0071927 | A1* | 3/2009 | Fily et al. | 215/254 |
| 2009/0084700 | A1 | 4/2009 | Visser et al. | |
| 2009/0117307 | A1 | 5/2009 | Culbertson et al. | |
| 2009/0166228 | A1 | 7/2009 | Kinunen | |
| 2009/0294531 | A1 | 12/2009 | Kantrowitz et al. | |
| 2009/0301633 | A1 | 12/2009 | Myers et al. | |
| 2010/0012542 | A1 | 1/2010 | Methuen | |
| 2010/0102109 | A1 | 4/2010 | Flecker et al. | |
| 2010/0126894 | A1 | 5/2010 | Koukol et al. | |
| 2010/0147724 | A1 | 6/2010 | Mitra-Shah et al. | |
| 2010/0178394 | A1 | 7/2010 | Exner et al. | |
| 2010/0181371 | A1 | 7/2010 | Messmer et al. | |
| 2012/0292322 | A1* | 11/2012 | Meyer et al. | 220/270 |

FOREIGN PATENT DOCUMENTS

| | | |
|---|---|---|
| EP | 1736417 | 12/2006 |
| GB | 2268731 A | 1/1994 |
| WO | WO2005082733 | 9/2005 |
| WO | WO2005082734 | 9/2005 |

* cited by examiner

TAMPER EVIDENT CONTAINER WITH FULL TAB

BACKGROUND OF THE INVENTION

Field of the Invention

The present invention generally relates to a container with a pull tab having a deformable formation, a tamper evident feature for a container, and a method for forming a container. Embodiments of the invention relate to containers with a pull tab that can be used in the food industry for storing, transporting, and showing foodstuffs.

Description of Related Art

Conventionally, there are many different types of containers used in the food industry for storing, transporting and showing foodstuffs on the shelves in shops and markets. One problem prevalent in supermarkets is that customers will occasionally attempt to obtain access to the contents of food containers to taste or examine the foods. This is clearly undesirable since this action could cause contamination of the foodstuffs and furthermore, other customers do not wish to buy the affected products. Several tamper-evident containers have been devised to address this problem.

U.S. Pat. Nos. 5,145,088 and 5,507,406 disclose known solutions, but it has been found that these and other conventional tamper-evident containers have various drawbacks in terms of cost and manufacture, and also that significant proportions of important parts of the container and/or cover are destroyed when the cover is opened for the first time.

SUMMARY OF THE INVENTION

The purpose and advantages of the present invention will be set forth in and apparent from the description that follows, as well as will be learned by practice of the invention. Additional advantages of the invention will be realized and attained by the apparatus and methods particularly pointed out in the written description and claims hereof, as well as from the appended drawings.

To achieve these and other advantages and in accordance with the purpose of the invention, as embodied and broadly described, the invention includes a container with a pull tab having a deformable formation. The container can be used to store, transport, and show foodstuffs, as well as any other suitable applications.

The container includes a base, a cover, and a pull tab. The base can include, but is not limited to, a bottom, a side wall extending upwardly from the bottom, and a rim at an upper edge portion of the sidewall. The cover has a closed condition and an open condition. The cover can include, but is not limited to, an outer edge portion interengageable with the rim of the base when the cover is in the closed condition. The pull tab extends outwardly from at least one of the base or the cover.

In accordance with one aspect of the invention, the pull tab has a deformable formation to be deformed when the cover is moved from a closed condition to an open condition. Furthermore, the pull tab is configured to remain attached to the at least one of the base or the cover when moved from the closed condition to the open condition. The deformable formation can include a plurality of recesses or protrusions defined on the surface of the pull tab. Further, the deformable formation can be configured to create an audible or visible indication upon application of sufficient force to the pull tab to disengage the outer edge portion of the cover from the rim of the base.

In accordance with another aspect of the invention, the outer edge portion of the cover and the rim of the base are interengageable when the cover is in the closed position. In a preferred embodiment, the outer edge portion of the cover or the rim of the base includes a channel to receive the other of the outer edge portion of the cover or the rim of the base for interengagement therebetween. The channel can have a cross-section configuration that corresponds to the other of the outer edge portion of the cover or the rim for mating interengagement therebetween.

The base can include a ramp aligned with the pull tab when the cover is closed. The pull tab can be angled relative to the outer edge portion of the cover by the ramp. In some embodiments, the base includes a textured area, which can define a grip area for the pull tab.

It is to be understood that both the foregoing general description and the following detailed description are exemplary and are intended to provide further explanation of the Invention claimed.

The accompanying drawings, which are incorporated in and constitute part of this specification, are included to illustrate and provide a further understanding of the apparatus and method of the invention. Together with the written description, the drawings serve to explain the principles of the invention.

DETAILED DESCRIPTION OF THE PREFERRED EMBODIMENT

Reference will now be made in detail to the present preferred embodiments of the invention, an example of which is illustrated in the accompanying drawings. The method and corresponding steps of the invention will be described in conjunction with the detailed description of the apparatus.

The apparatus and methods presented herein generally are intended for any two piece or hinged containers for storing, transporting, and showing foodstuffs, although other similar or suitable uses are contemplated. One aspect of the invention is particularly suited for containers requiring a method of illustrating tampering when opened. In accordance with the invention, a container having a base, a cover, and a pull tab having a deformable formation is provided. The base has a bottom, a side wall extending upwardly from the bottom, and a rim at an upper edge portion of the side wall. The cover has a closed condition and an open condition. The cover has an outer edge portion interengageable with the rim of the base when the cover is in the closed condition. The pull tab extends outwardly from at least one of the base or the cover. The pull tab has a deformable formation to be deformed when the cover is moved from the closed condition to the open condition. Furthermore, the pull tab is configured to remain attached to the at least one of the base or the cover when moved from the closed condition to the open condition.

Figure 1:
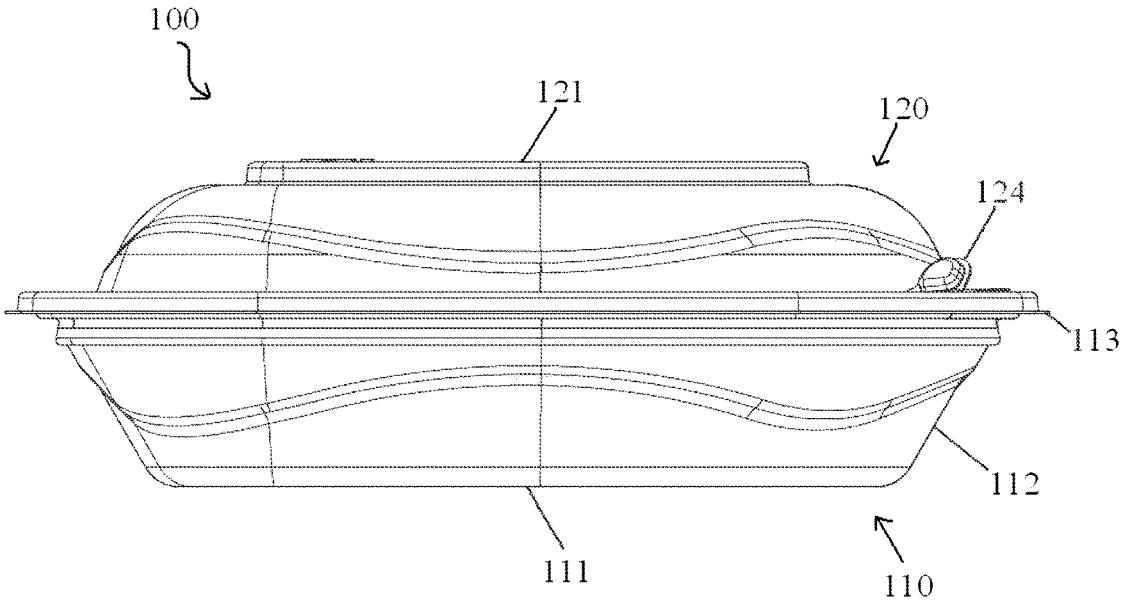
FIG. 1 is side view of a representative embodiment of a container in accordance with the invention.
Figure 2:
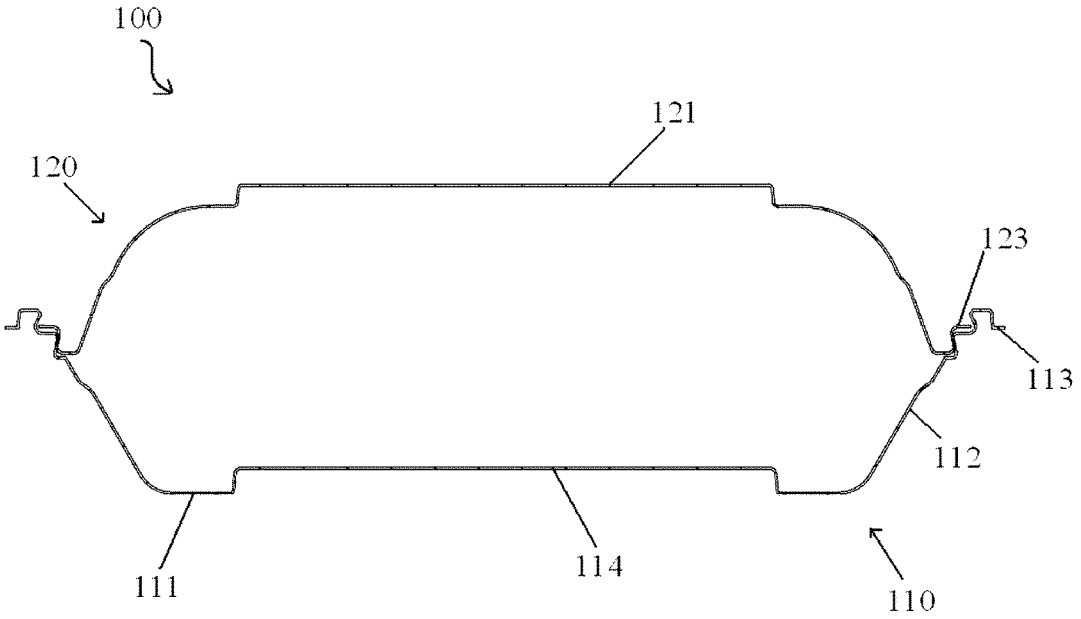
FIG. 2 is a cross-sectional side view along a mid-line of the container shown in FIG. 1
Figure 3:
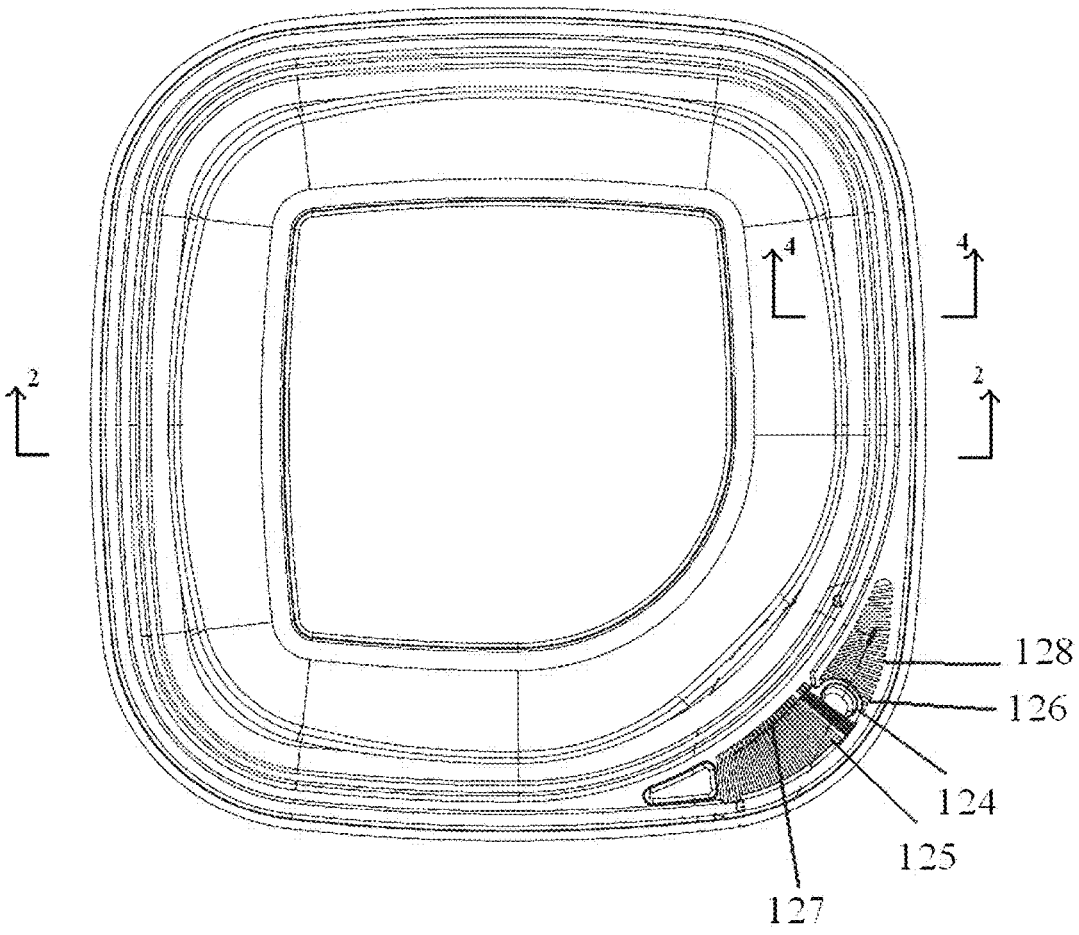
FIG. 3 is a top view of the container shown in FIG. 1

For purpose of explanation and illustration, and not limitation, an exemplary embodiment of the container in accordance with the invention is shown in FIGS. 1, 2, and 3 and is designated generally by reference character 100.

FIGS. 1 and 2 show a first embodiment of a container 100 in accordance with the invention. The container includes a base 110 having a bottom 111, a side wall 112 extending upwardly from the bottom, and a rim 113 at an upper edge portion of the side wall. In some embodiments, the base is generally bowl-shaped with a flat bottom. Alternatively, the bottom may have a raised center portion 114 such as shown in FIG. 2. The rim 113 extends radially outward from the upper edge portion of the side wall in generally a horizontal plane.

The container also includes a cover 120 having an outer edge portion 123 (not shown in FIG. 1) corresponding to the rim of the base. For purpose of illustration, the cover includes a pull tab 124 extending outwardly from the outer edge portion at a region of the periphery of the cover. The pull tab 124 has a deformable formation 125 (shown in FIG. 3) to be deformed when the cover is moved from a closed condition to an open condition. Although the base 110 and cover 120 are shown in FIGS. 1 and 2 as separate pieces, alternatively, the base and the cover can be hingedly connected using a variety of known techniques, as further described in International Publication No WO 2005/082734, filed Feb. 24, 2005, the entire disclosure of which is hereby incorporated by reference. Similarly, the pull tab can be configured to extend from the base, or if desired, a pull tab can extend from the cover and the base, respectively.

The container is made of suitable material having slight resilience and is particularly useful for holding foodstuffs such as fruit, vegetables and prepared foods such as salads, etc. Preferably, the cover is made of a clear plastics material so the foodstuff therein is visible to a consumer. The container can be rectangular, round or any other desired shape. Examples of materials include polystyrene, polypropylene, polyethylene terephthalate (PET), and other suitable materials.

Figure 5:
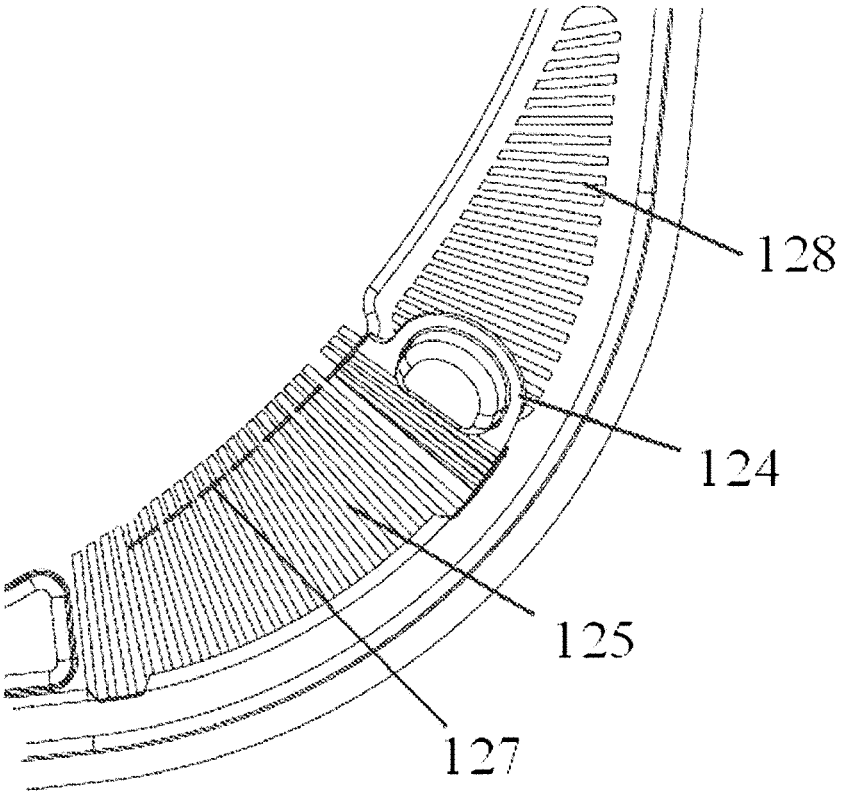
FIG. 5 is an enlarged view of the pull tab area of the base and cover shown in FIG. 3.
Figure 8:
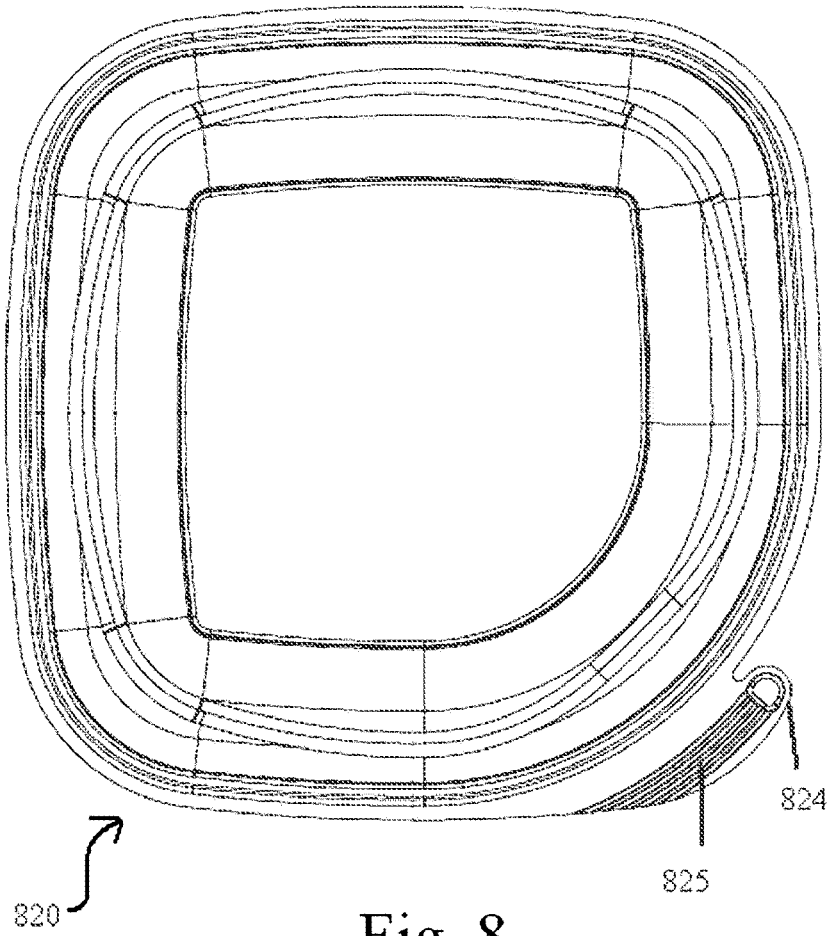
FIG. 8 is a top view of another representative embodiment of a cover of a container in accordance with the invention.

Generally, the pull tab has a deformable formation to be deformed when the container is moved from the closed condition to the open condition. For example, and with reference to the embodiment of FIG. 1 herein, the deformable formation 125 includes a plurality of recesses defined on a surface of the pull tab 124. Alternatively, the deformable formation includes a plurality of protrusions defined on a surface of the pull tab 124. The plurality of protrusions can be ribs, ridges, or any other suitable configuration capable of deformation when tampered, such as shown in FIG. 5. The recesses or ribs can extend radially as shown generally in FIG. 5 for more enhanced curling of the end of the tab, or extend linearly along the pull tab 824 of the cover 820 for curing of the lateral edge as shown as 825 in FIG. 8.

Figure 6:
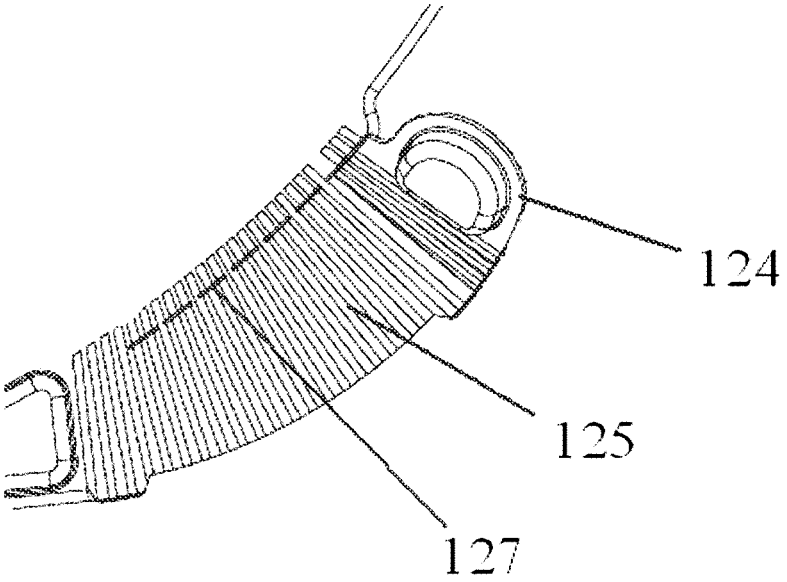
FIG. 6 is an enlarged view of the pull tab of the cover shown in FIG. 3 prior to assembly to the base.

Additionally or alternatively, the deformable formation can include a line of weakness or perforation 127 such as shown in FIG. 3 for the purpose of illustration and not limitation. The line of weakness can be scored cuts or any other suitable configuration, such as further described in U.S. Pat. No. 6,004,251 filed Aug. 6, 1997, the entire disclosure of which is hereby incorporated by reference. The shape of the pull tab after tampering can be selected by changing the shape of the perforation. For example, FIG. 6 shows one embodiment of a pull tab having a generally arcuate configuration as defined by the perforations, wherein the protrusions on the pull tab are a series of radially aligned ribs. As such, the visible indication that the container has been opened is provided by the line of weakness being broken. However, and as noted above, at least a portion of the pull tab remains attached to the cover, such that the pull tab can be used to open the cover.

In a preferred embodiment, the deformable formation is configured to create either an audible indication or a visible indication upon application of sufficient force to the pull tab to disengage the outer edge portion of the cover from the rim of the base. For example, the pull tab 124 is configured to create a visible indication upon application of sufficient force to the pull tab to disengage the outer edge portion of the cover from the rim of the base. The visible indication can include deformation of the deformable formation. For example, and without limitation, deformation of the deformable formation results in a distortion of the pattern of protrusion or recesses on pull tab 124. Alternatively or additionally, the visible indication can include curling of the pull tab and/or breaking of the line of weakness. This visible indication clearly alerts the consumer that the container has been opened previously. Additionally, the base can include text such as "Tamper Strip Activated," which generally is only visible to the consumer once the container has been opened.

Figure 7:
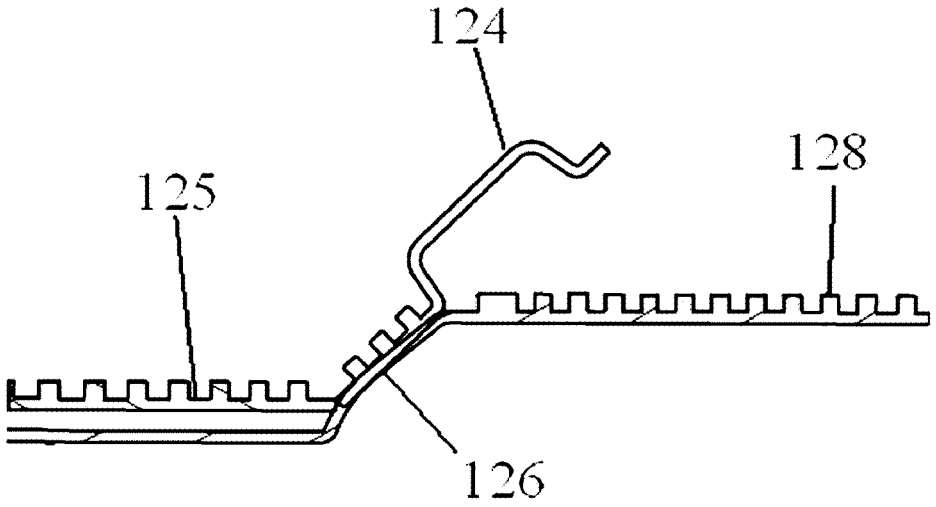
FIG. 7 is an enlarged side view of the ramp area shown in FIG. 5.
Figure 9:
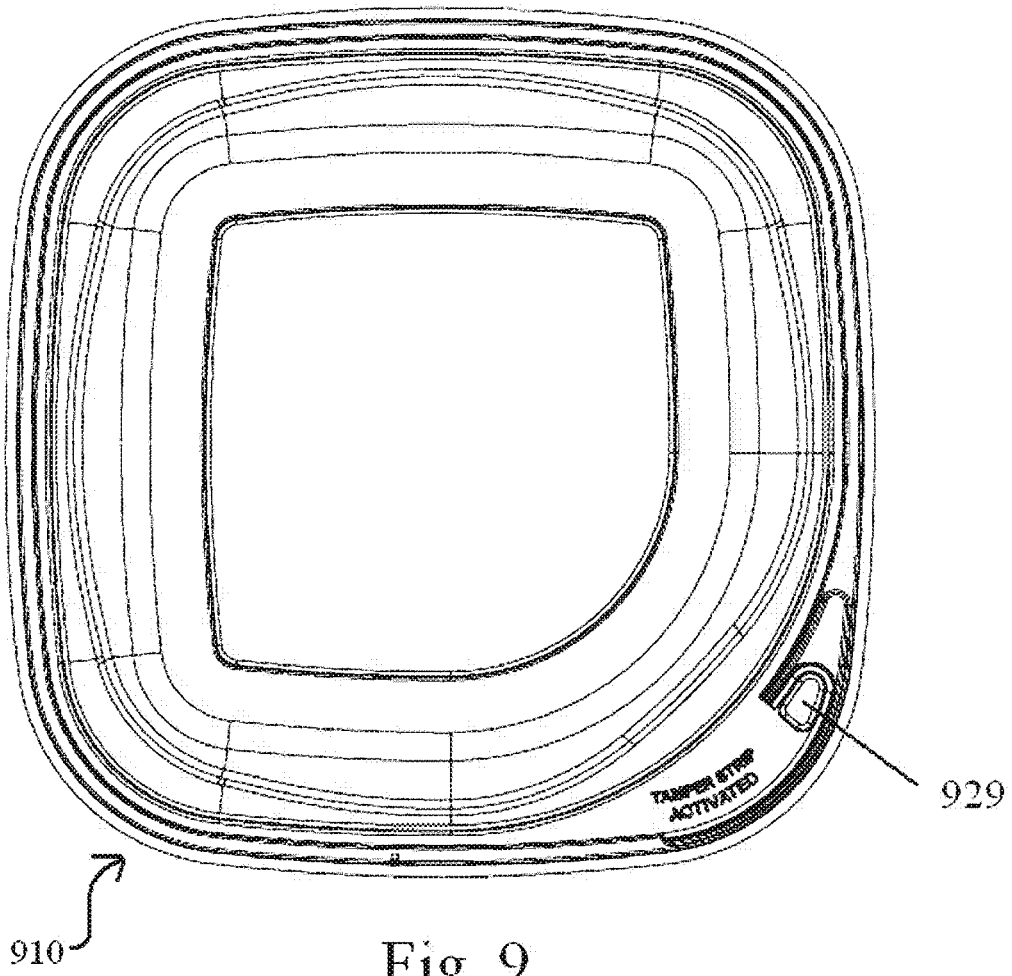
FIG. 9 is a top view of another representative embodiment of a base of a container in accordance with the invention.

According to another aspect of the invention, the base can include a ramp 126 such as shown in FIG. 3 for purpose of illustration. The ramp is aligned with the pull tab 124 when the cover is in the closed configuration. In a preferred embodiment, the ramp serves to angle the pull tab 124 relative to the outer edge portion of the cover, as shown in FIG. 7. This allows the user easier access the pull tab for opening the container. Alternatively, and as shown in FIG. 9, the base 910 can be free of a ramp such that the pull tab will lie flat when in the closed condition. Additionally, the base can include a recess or pocket 929 such as shown in FIG. 9 for the purpose of illustration. The pocket can be located underneath the tab such that a gap is created under the tab in order to more easily grasp and pull the tab and open the container.

The base can include a textured or reinforced area. The textured area can define a grip area for the pull tab 124. For purpose of illustration, the textured area 128 can be formed from a series of channels, which create parallel ribs therebetween. The reinforced area 128 typically stiffens the corresponding portion of the container and resists deformation of the container in the region of the pull tab 124.

The outer edge portion of the cover 123 and the rim of the base 113 are interengageable when the cover is in the closed condition. The outer edge portion of the cover or the rim of the base includes a channel to receive the other of the outer edge portion of the cover and the rim of the base for interengagement therebetween. The channel prevents access to the other of the outer edge portion of the cover and the rim of the base received therein when the cover is in the closed condition. For example, the channel can be defined at least in part by an angled wall, the angled wall being flexible for disengagement of the outer edge portion of the cover from the rim of the base when the cover is moved from a closed condition to the open condition.

Figure 4:
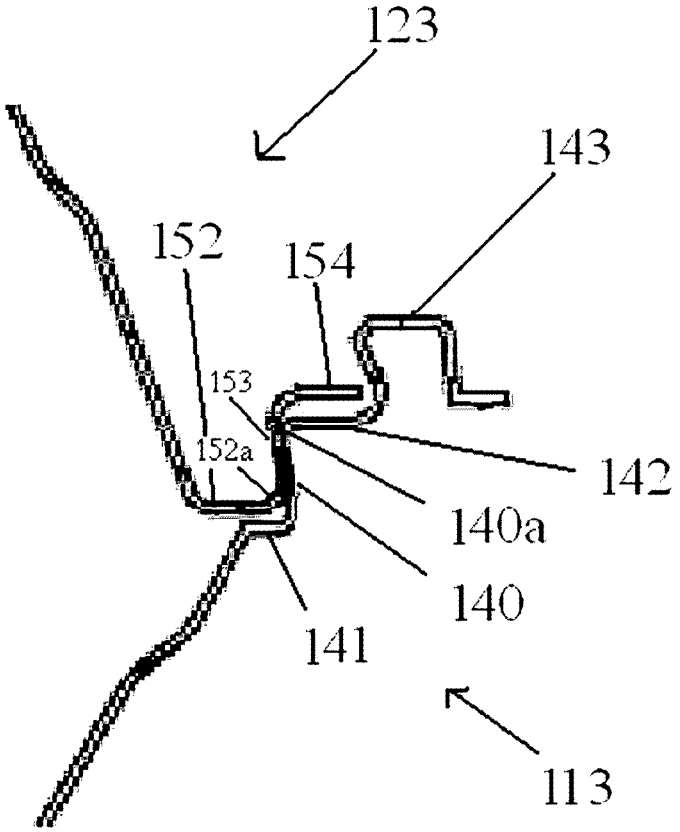
FIG. 4 is an enlarged cross-sectional side view of the rim area of the container of FIG. 2.

In one embodiment and as shown in FIG. 4 for illustration and not limitation, the rim 113 includes a side wall 140 extends upward and radially inward at an angle of 15 degrees (with respect to the vertical) from the outermost edge of the ledge 141. The side wall 140 continues inward and upward to apex 140*a* at outer ledge 142, which extends radially outward in the horizontal plane. A ridge 143 in the shape of an inverted U extends upward from the outer ledge 142. The ridge 143 generally extends around the perimeter of the base. In a hinged configuration, the ridge extends around a large portion of the base, apart from a region wherein a hinge (not shown) connects the base 10 and the cover 120. The ridge generally retains its inverted U shape at the pull tab area 124, but as the ledge expands radially outward from the base 110, its horizontal surface includes a ramp 126.

As embodied herein for the purpose of illustration, the cover 120 has a generally flat central plate 121. The cover 120 is contoured downward when in the closed position and radially outward from the central plate 121 to form an annular ridge surrounding the plate 121. The ridge has a radially inner wall formed by the contoured outer region of the cover 120, which extends radially outwards to a generally horizontal wall 152. Extending from horizontal wall 152 is a radially outer wall 153 at an apex 152*a*. The outer wall 153 extends upward and radially inward at an angle of about 10 degrees, with respect to vertical, toward the central plate 121 Other angles can be used if desired. Extending from outer wall 153 is a generally horizontal annular rim 154.

When the container 100 is filled and is to be closed, the cover 120 is pushed down on the base 110 until the apex 152*a* moves past the apex 140*a* of the side wall 140. The angle between the side wall 140 and the ledge 141 forms an undercut, which secures the cover 120 in place.

The cover 120 is generally over-sized with respect to the base 110, such that the base 110 will expand somewhat when the cover 120 is closed in order for the base 110 to accommodate the cover 120. The deformation is typically maintained while the cover 120 is in place on the base 110. This forms a seal between the cover 120 and the undercut more secure and less prone to leaks, and makes it less likely that the cover 120 will accidentally become detached from the base 110. Also, the resultant forces of tension created in the base and compression exerted on the cover increase the rigidity of the container when it is closed.

The wall 153 of cover 120 and the side wall 140 of the base 110 can be, but are not necessarily, set at different angles. For example, the angle between the side wall 140 of the base 110 and the vertical can be more acute than the angle between the wall 153 of the cover 120 and the vertical. The mismatch of the angles between the walls means that each has to deform to snap together. This mismatch between the angles increases the deformation of the cover 120 and the base 110, and stretches out the walls of the base 110 when the cover 120 is in place as the two wall portions 153 and 140 seek to lie flat against one another in the closed container. This in turn increases the rigidity of the container and the security of the seal. Alternatively, the angle between the side wall 140 of the base 10 and the vertical and the angle between the wall 153 of the cover 120 and the vertical could be the same.

As the cover 120 is closed and the side wall 153 enters the undercut, the annular rim 154 lies flat on top of the outer ledge 142. The edge of the rim 154 cannot be accessed because of the ridge 143 that surrounds the ledge 142. This further prevents tampering with the contents of the container.

In the closed container 100, the tab 124 overlies the ramp 126. When the container 100 is to be opened, the tab 124 is pulled until the perforation 127 breaks and the pull tab curls. In certain embodiments, the pull tab can be surrounded by the perforation 127 on one side or both sides.

In some embodiments, pulling the cover 120 away from the base 110 is facilitated by the reinforced area 128. The reinforced area 128 acts as a finger grip allowing a user a purchase as the pull tab 124 is used to pull the cover 120 away from the base 110.

As discussed previously herein, the reinforced area 128 performs the function of imparting strength to the region surrounding the pull tab 124. Typically the material from which the container 100 is produced is deformable. This has potentially adverse consequences for larger containers since the flexibility could allow partial separation of base 110 and cover 120 without disrupting the line of weakness 127. The reinforced area 128 provides increased rigidity of the container to restrict deformation. Reinforced area 128 can be located in any region of the container which requires strengthening and the use of multiple reinforced areas is contemplated.

Once the line of weakness or perforation 127 has been broken for the first time the pull tab cannot be returned to its original condition, which serves as evidence of opening or tampering of the container. Thus a retail outlet can tell if the foodstuffs within the container have been accessed before sale, and the consumer can tell if the foodstuffs have been accessed before purchasing the foodstuff.

In accordance with another aspect of the invention, a method of forming a container is provided. The method includes providing a base having a bottom, a side wall extending upwardly from the bottom, and a rim at an upper edge portion of the side wall, providing a cover having a closed condition and an open condition, and an outer edge portion interengageable with the rim of the base when the cover is in the closed condition, and providing a pull tab extending outwardly from at least one of the base or the cover. The pull tab has a deformable formation to be deformed when the cover is moved from a closed condition to an open condition. Furthermore, the pull tab is configured to remain attached to the at least one of the base or the cover when moved from the closed condition to the open condition. The base, cover, and pull tab can have any of the properties mentioned previously herein. The container and features described herein can be formed using any suitable technique based upon the material of construction. For example, thermoforming techniques can be used to form the cover with pull tab and related protrusions and perforations if made of plastic sheet. Alternative techniques include injection molding, blow forming, compression molding, rotational molding, and other suitable techniques.

In accordance with another aspect of the invention, a method of containing product in a container is provided. The method includes providing a container having a base and a cover. The base has a bottom, a side wall extending upwardly from the bottom, and a rim at an upper edge portion of the side wall. The cover has a closed condition and an open condition, and an outer edge portion interengageable with the rim of the base when the cover is in the closed condition. A pull tab is provided extending outwardly from at least one of the base or the cover. The pull tab has a deformable formation to be deformed when the cover is moved from a closed condition to an open condition. The pull tab is configured to remain attached to the at least one of the base or the cover when moved from the closed condition to the open condition. The method further includes pulling the pull tab to move the cover from a closed condition to an open condition, wherein the deformable formation deforms while the pull tab remains attached to the at least one of the base or the cover.

While the present invention is described herein in terms of certain preferred embodiments, those skilled in the art will recognize that various modifications and improvements may be made to the invention without departing from the scope thereof. Thus, it is intended that the present invention include modifications and variations that are within the scope of the appended claims and their equivalents. Moreover, although individual features of one embodiment of the invention may be discussed herein or shown in the drawings of one embodiment and not in other embodiments, it should be apparent that individual features of one embodiment may be combined with one or more features of another embodiment or features from a plurality of embodiments.

In addition to the specific embodiments claimed below, the invention is also directed to other embodiments having any other possible combination of the dependent features claimed below and those disclosed above. As such, the particular features presented in the dependent claims and disclosed above can be combined with each other in other manners within the scope of the invention such that the invention should be recognized as also specifically directed to other embodiments having any other possible combinations. Thus, the foregoing description of specific embodiments of the invention has been presented for purposes of illustration and description. It is not intended to be exhaustive or to limit the invention to those embodiments disclosed.

The invention claimed is:

1. A container having a central axis comprising a base having a bottom, a side wall extending upwardly from the bottom, and a rim at an upper edge portion of the side wall;

a cover having a closed condition and an open condition, the cover having an outer edge portion interengageable with the rim of the base when the cover is in the closed condition; and a pull tab having an arcuate edge and extending outwardly relative to the central axis from the cover when in an initial closed condition, wherein the base includes a ramp aligned with the pull tab when the cover is in the initial closed condition, the pull tab being angled relative the outer edge portion of the cover by the ramp to define a gap between the pull tab and the outer edge portion of the cover, the pull tab having a deformable formation including a pattern of elongated ribs extending radially outward and a line of weakness transverse the elongated ribs, the elongated ribs configured to cause and maintain a distortion of the deformable formation and curling of the pull tab when the deformable formation is separated along the line of weakness due to deformation along a length between adjacent ribs to create a visible indication when the cover is moved from the initial closed condition to the open condition, the pull tab remaining curled and attached to the cover when the cover is moved from the initial closed condition to the open condition.

2. The container of claim 1, wherein the deformable formation is configured to create an audible indication upon application of sufficient force to the pull tab to disengage the outer edge portion of the cover from the rim of the base.

3. The container of claim 1, wherein the visible indication is created upon application of sufficient force to the pull tab to disengage the outer edge portion of the cover from the rim of the base.

4. The container of claim 1, wherein the visible indication includes a separation along the line of weakness.

5. The container of claim 1, wherein at least one of the outer edge portion of the cover and the rim of the base includes a channel to receive the other of the outer edge portion of the cover and the rim of the base for interengagement therebetween.

6. The container of claim 5, wherein the channel prevents access to the other of the outer edge portion of the cover and the rim of the base received therein when the cover is in the closed condition.

7. The container of claim 5, wherein the channel is defined at least in part by an angled wall, the angled wall being flexible for disengagement of the outer edge portion of the cover from the rim of the base when the cover is moved toward the open condition.

8. The container of claim 1, wherein at least a portion of the base is provided with a textured area.

9. The container of claim 8, wherein the textured area defines a grip area for the pull tab.

10. The container of claim 1, wherein the base and the cover are hingedly connected.

11. The container of claim 1, wherein the line of weakness defines a lateral edge of the pull tab.

12. The container of claim 1, wherein the base includes text visible when the cover is moved from the initial closed condition to the open condition to create a further visible indication when the cover is moved from the initial closed condition to the open condition.

* * * * *